US005967562A

United States Patent [19]

Tubbs et al.

[11] Patent Number: 5,967,562

[45] Date of Patent: Oct. 19, 1999

[54] MANUFACTURER'S INDICATOR AND METHOD FOR COLOR COORDINATION AND STYLE

[76] Inventors: Macie Jeanette Tubbs, Rte. 2, Box 330-A4, Sallisaw, Okla. 74955; Tona Kaye Coleman, 4805 Alma Hwy., Van Buren, Ark. 72956; Steve Daniel George, P.O. Box 748, Sallisaw, Okla. 74955

[21] Appl. No.: 08/990,845

[22] Filed: Dec. 15, 1997

Related U.S. Application Data

[63] Continuation-in-part of application No. 08/659,888, Jun. 6, 1996, abandoned.

[51] Int. Cl.[6] ..... B42D 15/00

[52] U.S. Cl. ..... 283/114; 283/67; 283/70

[58] Field of Search ..... 283/67, 114, 70, 283/117, 56, 72; 434/98, 99, 100; 40/299

[56] References Cited

U.S. PATENT DOCUMENTS

| | | | |
|---|---|---|---|
| 1,582,122 | 4/1926 | Clapp . | |
| 1,733,539 | 10/1929 | Hertel . | |
| 2,221,774 | 11/1940 | Bowser . | |
| 3,040,448 | 6/1962 | Paxton . | |
| 3,860,015 | 1/1975 | Tarro | 132/315 |
| 4,096,655 | 6/1978 | Ullman, Jr. | 40/299 |
| 4,514,178 | 4/1985 | Noto et al. | 434/395 |
| 4,681,546 | 7/1987 | Hart | 434/99 |
| 4,734,938 | 4/1988 | Anderson | 2/239 |
| 4,854,880 | 8/1989 | Nasby | 434/395 |
| 5,217,378 | 6/1993 | Donovan | 434/116 |
| 5,311,293 | 5/1994 | MacFarlane et al. | 356/421 |
| 5,313,267 | 5/1994 | MacFarlane et al. | 356/405 |
| 5,537,211 | 7/1996 | Dial | 356/402 |
| 5,839,215 | 11/1998 | Lasprogata | 40/299.01 |

FOREIGN PATENT DOCUMENTS 29702486 6/1997 Germany .

OTHER PUBLICATIONS

Barnard, Anne, "Visually Impaired Find Art at Their Fingertips a Barnes Program Teaches People With Poor Vision to Experience Paintings Through Touch", Philadelphia Inquirer, Dec. 24, 1996, p. B01.

Grannis, Chandler, "So That the Blind May See: Debossing, Color Codes and Braille–Along with Extensive Research–Bring Color Photography to the Visually Impaired", Publishers Weekly,v237,n46,p23.

Schneider, Phyllis, "Keeping Your Child's Eyes Healthy", Parents, v. 70, n. 11, pp. 47–48.

*Primary Examiner*—Willmon Fridie, Jr.
*Attorney, Agent, or Firm*—Frank L. Hart

[57] ABSTRACT

A labeling apparatus connectable to an item for designating a manufacturer's preferred style of an item, the item's color family and the manufacturer's suggested color contrasting intensity for matching of second items relative to said preferred style. Described is the method of using such labeling apparatus in selecting items matching in style, color family, and color contrasting intensity.

6 Claims, 2 Drawing Sheets

Fig_2a_
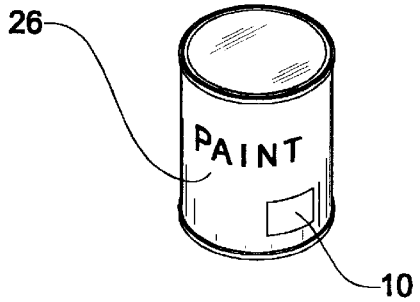
Fig_2b_
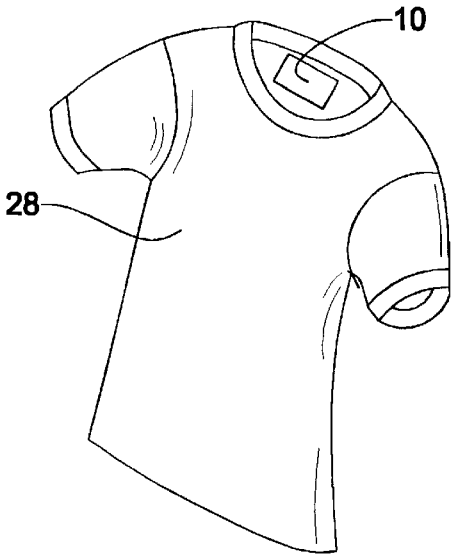
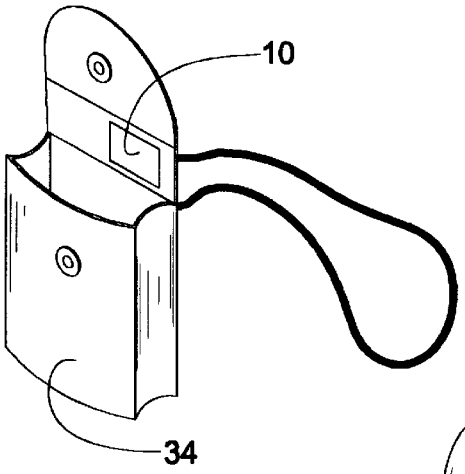
Fig_2c_
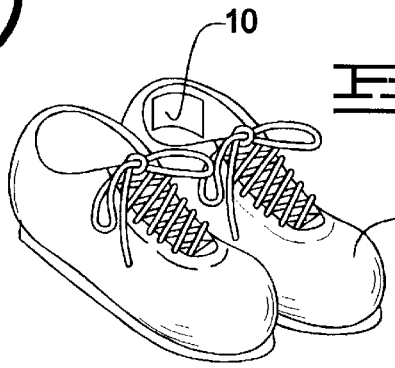
Fig_2d_
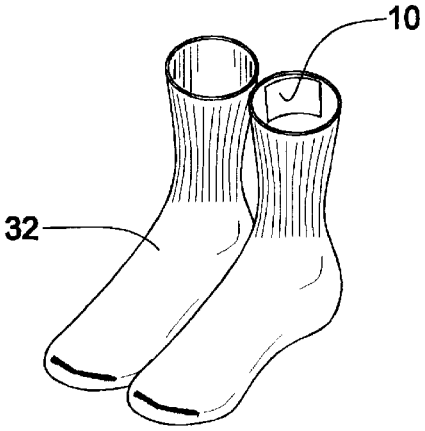
Fig_2e_
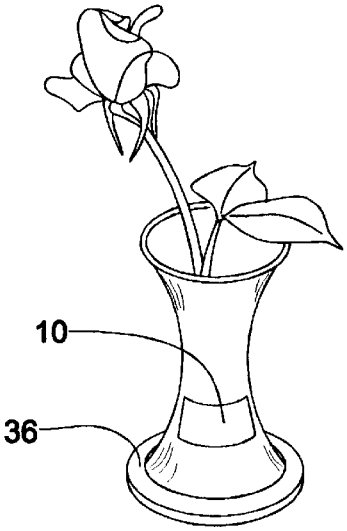
Fig_2f_

MANUFACTURER'S INDICATOR AND METHOD FOR COLOR COORDINATION AND STYLE

This patent application is a continuation-in-part (CIP) of U.S. patent application Ser. No. 08/659888 filed Jun. 6, 1996, now abandoned.

TECHNICAL FIELD OF THE INVENTION

The present invention relates to a manufacturer's indicating label and method of using same for color coordination of multiple items. More particularly, this invention relates to categorizing the color of objects into color families and subcategorizing the objects according to color contrast intensity relative to a style preselected by the manufacturer.

BACKGROUND OF THE INVENTION

As is recognized in fashion circles, the combination of certain colors with other colors may be attractive or unattractive depending upon the colors used in combination. The ability to select pleasing color combinations is an important skill with applications in selecting the colors of clothing and accessories as well as in other areas such as home decorating. Home decorating applications include the selection of appropriate colors for furniture upholstery, drapes, paint color for interior walls, wallpaper, and other applications such as selection of decoration, e.g., flowers.

Attempts have been made to assist individuals who are deficient in color coordinating skills. Examples of past attempts include U.S. Pat. No. 1,718,919 to Fitzgibbon for a merchandising tag provided with a color harmony chart adapted to be attached to color fabric articles such as hosiery. U.S. Pat. No. 1,733,539 to Hertel discloses color cards for attractively displaying samples of material of different colors and for identifying such colors by name or number. Another patent for color coordination is U.S. Pat. No. 5,180,062 to Stables, which teaches a fabric matching method.

It has additionally been recognized that certain colors are more appealing on some individuals than the colors on other individuals. The degree of attractiveness depends upon certain personal characteristics of an individual, known as "color contrast intensities", such as skin tone, hair color, and eye color. Attempts to assist individuals in choosing a color that is harmonious with the individual's color contrast intensities is taught in U.S. Pat. No. 4,909,632 to McFarlan and in U.S. Pat. No. 4,561,850 to Fabbri.

Despite the importance of selecting items that are color coordinated with one another as well as selecting items that are harmonious with an individual's color contrast intensity, many individuals do not possess the skills to select or determine what is necessary for appropriate color harmonization. The psychological benefits associated with proper color selection include increased self-esteem and improved confidence. Consequently, there exists a need for a method of selecting the appropriate color for the many items requiring color coordination. The method selecting colors should remove the uncertainty, guess work, and confusion experienced by the many people with poor color grouping or color harmonizing skills. Such a method would additionally benefit individuals afflicted with color blindness and would enable a color blind person to feel confident that he or she has selected items of appropriate colors. Similarly, since the preferred embodiment of the method of the invention utilizes symbols in addition to wording, the invention additionally benefits individuals who cannot read or who have little or no knowledge of the English language.

In another aspect of the present invention, the manufacturer of an article can provide information on the article which will guide the customer in coordinating separate items which will produce a style the manufacturer desires and recommends. By utilizing the style classification on articles manufacturer maintains greater control of his items, thereby promoting the statement he desires to make to the fashion industry.

By this style augmented system of color selection, items produced by a different manufacturer can easily be matched to produce a preselected appearance desired by the customer. Additionally, the style augmented system permits the customer to maintain a preselected style while matching multiple items to his particular physical appearance or desires.

SUMMARY OF THE INVENTION

In one aspect of the invention, a method is provided for matching separate items of different colors and different color contrast intensities and manufacturer's preselected style. A first item is selected and is identified by symbols indicating the manufacturer's preferred style, the first item's dominating primary color and at least one of the manufacturer's suggest color contrast intensities. A second item is selected from a group of second items, said second item being identified as having about the same preferred style of the first item, the same dominating primary color of the first item and one of the color contrast intensity symbols of said first item.

In another aspect of the invention, an apparatus is connectable to an item for designating a manufacturer's preferred style and indicating the manufacturer's suggested matching of second items relative to said preselected style. A plurality first markings progressively represent a range of styles. A first symbol indicates the manufacturer's preferred style of said item. A second symbol is selected from a group of primary color families with said second symbol indicating the primary color family of said item. A third symbol is selected from a group of color contrasting intensities with said third symbol indicating at least one of the color contrasting intensity of items suggested by the manufacturer to be selected in response to the manufacturer's selected style and primary color family of the item.

BRIEF DESCRIPTION OF THE DRAWINGS

A more complete understanding of the invention and its advantages will be apparent from the detailed description taken in conjunction with the accompanying drawings in which:

FIGS. 2*a–f* are each an assortment of items shown with the color family and color contrast intensity indicators shown affixed thereon;

DETAILED DESCRIPTION OF THE INVENTION

Figure 1:
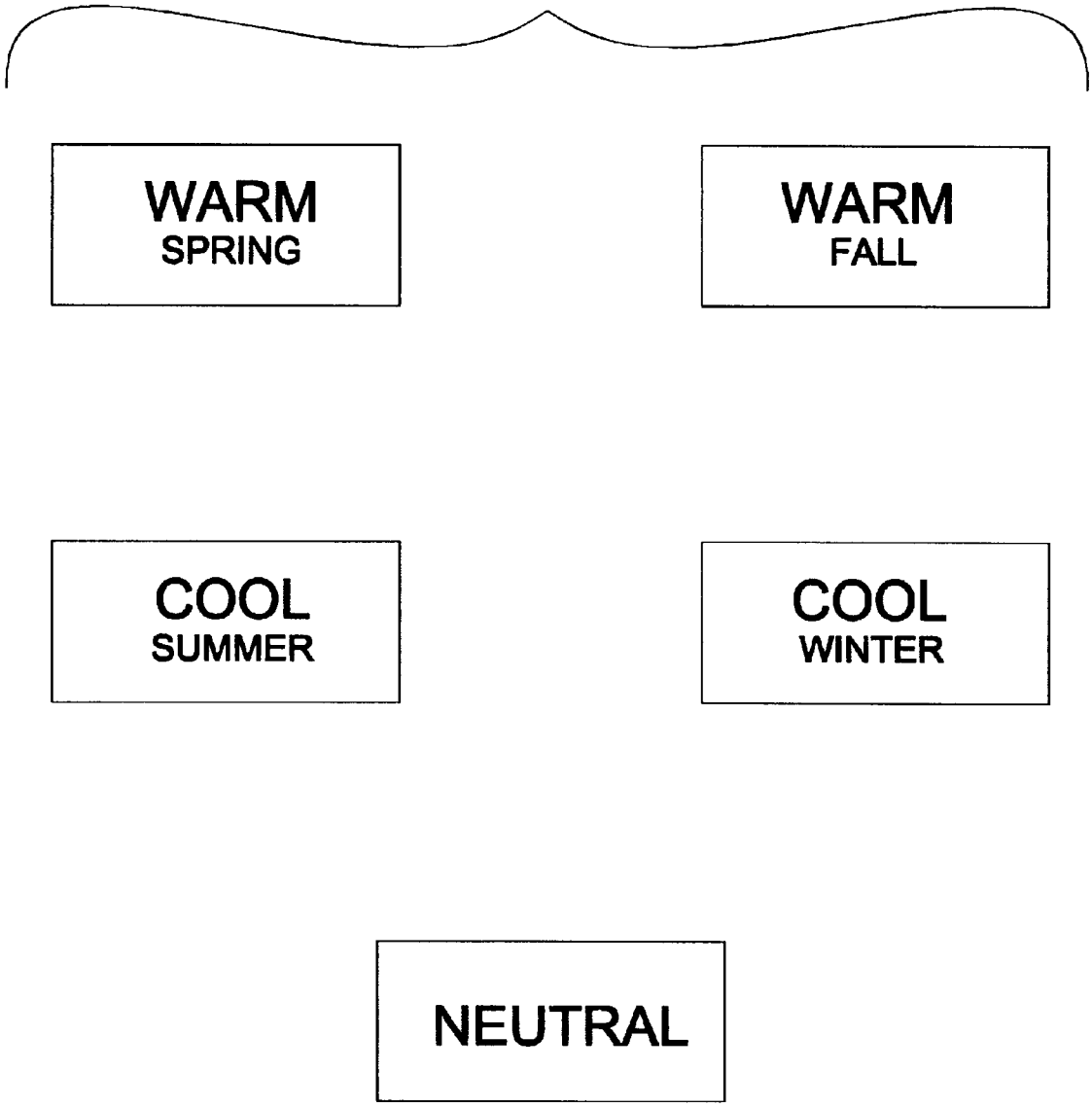
FIG. 1 is a perspective view of the color family and color contrast intensity indicators.

Referring to FIG. 1, the color family and color contrast intensity indicator or label is designated generally by the numeral 10. The color family and color contrast intensity indicator is shown on the color family indicator or label 10 of the item to which it will be attached. "Warm 12", "Cool 14" and "Neutral 16" are color family indicators. "Spring 18", "Fall 20", "Summer 22", and "Winter 24" are color contrast intensity indicators.

Referring to FIGS. 2*a–f*, are examples of the wide variety of items that may be color coordinated by using the apparatus and method of the instant invention. The items shown herein are merely examples of the types of items which may be so color coordinated. Certainly, many other types of items are also capable of being color coordinated with other items and FIGS. 2*a–f* are not meant to exclude any such items from the applicant's novel method of color coordination.

Color family and color contrast intensity indicator 10 is shown affixed to a typical can of household paint 26. Similarly, color family and color contrast intensity indicator 10 is shown affixed to articles of clothing, such as a shirt 28, shoes 30 and socks 32. Additionally, color family and color contrast intensity labels 10 may be affixed to any and all types of clothing accessories such as handbags or purses 34. Funky, as another example, color family and color contrast intensity labels 10 may be used on a variety of home decorations, such as flower pot and arrangement 36.

In practice, the invention may be used to color coordinate an infinite variety of items encountered in everyday life. This method is particularly advantageous for individuals having color blindness, but is also beneficial for individuals who do not possess good color coordination skills. Since it is well-known that society places importance on effective color harmonization for clothing and other items, it is important for these individuals to be able to select appropriate color combinations with confidence. All that is required to use the applicant's color coordination method is that such an individual select items in his surroundings, such as clothing and home decorations, wallpaper, etc. from appropriate color categories or families. For example, an individual who possesses a "Fall" color contrast intensity would be careful to select items having color contrast indicator 20. By exclusively purchasing items that are categorized as being compatible with a "Fall" color contrast intensity, an individual is assured of surrounding himself or herself with items that complement his or her contrast intensity. Similarly, by selecting items from the same color family, e.g. the "Warm" color family, an individual can be assured of selecting colors which are harmonious with one another. The appropriate selection is accomplished by the individual simply referring to the symbols of the label 10 and selecting from items which have the "Warm" color family 12 designated.

This method is not only of great value in assisting an individual in selecting the appropriate clothing, but can be utilized for color coordination of multiple items of every description.

In the preferred embodiment of this invention, color coordination of separate items, as set forth above is further enhanced by establishment of item style. In this preferred system, the manufacturer of an item designates the style he prefers of his item, the color family of the item (warm 12, cool 14, or neutral 16) and the color contrast intensity (spring 18, fall 20, summer 22, or winter 24). In order to assist the customer, a style range is indicated with progressive symbols, for example, the extremes of the range are described.

Although the style range may differ from manufacturer to manufacturer, a customer can readily compare the range of one item to a different range of another item and easily estimate the range differences and closely determine matching styles.

For example, a manufacturer "A" has a style range of 1–10 and has designated a particular item to be style 4 and different manufacturer "B" has a style range of 1–5 and has indicated his manufactured item to be a style 2. It is therefore easily recognizable that a style 4 of manufacturer "A" is the same or similar to a style 2 of manufacturer "B". Naturally, as manufacturers work together to develop a standardized style range, such estimation will not be necessary.

It should also be understood that intermediate points within a style range can also be described. This is particularly important where the style range is of greater magnitude.

For example, one extreme of style range might customarily be designated "casual" with the other extreme designated "formal". Such a style range would not include a style identification for an item the manufacturer would deem to be extremely radical or different. Such extremely radical or different styles might be described by various different words, such as, funky, hippie, radical, extreme, country, or some other descriptive designation. In such cases, the "casual" designation or other intermediate definition could fall at an intermediate location along the progressive style range.

The following are a few examples of information on the indicator or label 10 that may be firmly or removably affixed to an item using this style-augmented system:

EXAMPLE 1

Style Range: I–V
I=Casual; V=Formal
Style classification: II
Color Family: Cool
Color Contrast Intensity: Summer, Winter, or Neutral

EXAMPLE 2

Style Range: I–VIII
I=Casual; VIII=Formal
Style classification: V
Color Family: Warm
Contrast intensity: Spring, Fall or Neutral

EXAMPLE 3

Style Range: I–XII
I=Exotic IV=Casual XII=Formal
Style classification: II
Color Family: Warm
Color Contrast Intensity: Summer Note: in example 3, it should be noted that the style designated by the manufacturer is in the exotic range and to assure his style preference is met, he is suggesting color coordination outside the generally acceptable color coordination standards.

It should be understood that the above examples are for illustration only and the actual labels can depart from the words and/or symbols utilized herein without departing from the invention as claimed. It is only necessary that the label indicate the style of the article, the color family of the article or item, and the color contrast intensity which will coordinate with the color family in a manner resulting in the style proposed by the manufacturer.

Utilizing these examples, it can be seen that if a first article is chosen which has a label as in Example 1, an accessory or second article will color coordinate with the first article if the label of the second article is in the same color family and same color contrast intensity as that shown on the label of the first article. Further, by matching the style of the second article to the style of the first article assures the customer that the overall appearance will correspond with the statement the designer desires to make.

By following the manufacturer's suggestions as set forth on the label, the customer is in effect utilizing the expertise of the manufacturer in color matching, style selection, and coordination. Since the manufacturer generally has a vast number of design personnel having great knowledge, expertise and skill in designing product, the results of the label suggestions will most always be far superior to that capable of being achieved by a single individual.

In describing the method of using the labels of this invention, clothing will be utilized as the example article or items to be color coordinated and matched for style. Let's assume that a customer sees a blouse she wishes to purchase. The label in the blouse has a style range of I–VII with I being casual and VII being formal. The label additionally indicates that the manufacturer's preferred style is III on the style range. This style, when compared to the style range indicates that the manufacturer has designated the article for more "dressy" occasions while remaining under the general classification of "casual".

With this knowledge in mind, the customer goes to the skirt and slacks areas and looks at the styles listed as Style III. She then further limits her investigation by looking for Style IIIs which have the same Color Family and Color Contrast Intensity symbols as that listed on the blouse.

It should be understood that further style control can be achieved by the manufacturer where the items being matched are manufactured by the same company. Where this occurs, the weight texture, type of material and other physical properties can be matched by the Style symbol or could be additionally added as an additional symbol. Such additional product defining symbol might be most beneficial in other product areas, such as household paint, etc.

Once customers discover appearance enhancement by coordinating style, color family and color contrast intensity, they will become more loyal to the manufacturer who uses this system and more closely represents the customer's taste.

Although the present invention and its advantages have been described in detail, it should be understood that various changes, substitutions, and alterations can be made therein without departing from the spirit and scope of the invention as defined by the appended claims.

What is claimed is:

1. An apparatus connected to an item for designating a manufacturer's preferred style of the item, and indicating the manufacturer's suggested color family and color intensity, for matching of a second item relative to said preselected style:

a plurality of first markings representing a progressive range of styles;

a first symbol indicating a manufacturer' preferred style for said item and for matching said second item therewith;

a second symbol selected from a group of primary color families, said second symbol indicating the primary color family of said item; and a third symbol selected from a group of color contrasting intensities, said third symbol indicating at least one color contrasting intensity of items, suggested by the manufacturer to be selected in response to the manufacturer's selected style and the primary color family of the item.

2. An apparatus, as set forth in claim 1, wherein the primary color families are selected from the group consisting of warm, cool, and neutral.

3. An apparatus, as set forth in claim 1, wherein the color contrasting intensities are selected from the group consisting of spring, summer, fall and winter.

4. An apparatus, as set forth in claim 1, wherein the apparatus is a label fixed to the item.

5. An apparatus, as set forth in claim 1, wherein the apparatus is a hang tag connected to the item.

6. A method for matching separate items of different colors and different color contrast intensities for matching a manufacturer's preselected style, comprising:

selecting a first item identified by symbols indicating the manufacturer's preferred style, the first item's dominating primary color and at least one manufacturer's suggested color contrast intensities; and selecting a second item identified by a manufacturer as having about the same preselected style of the first item, the dominating primary color of the first item, and one of the color contrast intensity symbols of the first item.

* * * * *